US006417282B2

(12) United States Patent
Takesue et al.

(10) Patent No.: US 6,417,282 B2
(45) Date of Patent: Jul. 9, 2002

(54) GOLF BALL AND COVER STOCK

(75) Inventors: Rinya Takesue; Yasushi Ichikawa; Shunichi Kashiwagi, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/835,573

(22) Filed: Apr. 17, 2001

Related U.S. Application Data

(62) Division of application No. 09/366,280, filed on Aug. 2, 1999, now Pat. No. 6,268,437.

(30) Foreign Application Priority Data

Jul. 31, 1998 (JP) ..... 10-230285

(51) Int. Cl.[7] ..... C08J 91/06; C08L 23/04; C08K 5/01; A63B 37/12

(52) U.S. Cl. ..... 525/275; 524/487; 524/490

(58) Field of Search ..... 524/275, 487, 524/490; 473/365, 372, 373, 385

(56) References Cited

U.S. PATENT DOCUMENTS

| | | | | |
|---|---|---|---|---|
| 5,019,320 A | * | 5/1991 | Hasegawa et al. | 473/372 |
| 5,565,524 A | | 10/1996 | Hamada et al. | 525/200 |
| 5,625,003 A | | 4/1997 | Kato et al. | 525/208 |
| 5,848,943 A | | 12/1998 | Sano et al. | 473/365 |
| 5,919,862 A | | 7/1999 | Rajagopalan | 525/63 |

FOREIGN PATENT DOCUMENTS

| | | |
|---|---|---|
| JP | 63-58856 | 11/1988 |

* cited by examiner

*Primary Examiner*—Ana Woodward
(74) *Attorney, Agent, or Firm*—Sughrue Mion, PLLC

(57) ABSTRACT

The invention provides a golf ball cover stock based on a heated mixture of (a) an ionomer resin, (b) polyethylene, and (c) an epoxy group-modified polyolefin or (d) a low molecular weight polyethylene wax. Component (c) or (d) improves the dispersion of polyethylene in the ionomer resin so that a larger amount of polyethylene may be blended in micro-dispersion form. A golf ball having a cover made of the cover stock is durable and wear resistant and offers a good feel when hit.

14 Claims, No Drawings

GOLF BALL AND COVER STOCK

This is a Divisional of application Ser. No. 09/366,280 filed Aug. 2, 1999 now U.S. Pat. No. 6,268,437 the disclosure of which is incorporated herein by reference.

This invention relates to golf balls, and more particularly, cover stocks and golf balls using the same.

BACKGROUND OF THE INVENTION

Ionomer resins are now in widespread use as the golf ball cover material. Ionomer resins are ionic copolymers of an olefin such as ethylene with an unsaturated carboxylic acid such as acrylic acid, methacrylic acid or maleic acid, wherein some acidic groups are neutralized with metal ions such as sodium or zinc ions. Because of the excellent properties of resilience and scratch resistance, the ionomer resins are best suited as the base resin of the golf ball cover stock.

Since golf balls using ionomer cover stocks were marketed, cover stocks surpassing the properties of the ionomer cover stock have not been commercialized. The ionomer covers predominate in the current golf ball covers.

An attempt to develop a new type of cover stock surpassing the properties of the ionomer cover stock requires to find another resin that can be blended with an ionomer resin as the base so as to improve the properties of the blend without detracting from the properties of the ionomer resin itself.

JP-B 63-58856 discloses a cover stock in which a medium to low density polyethylene is blended with an ionomer resin as the base. More specifically, 1 to 9 parts by weight of a medium to low density polyethylene is blended with 100 parts by weight of an ionomer resin to formulate a cover stock. This is effective for improving the durability of a golf ball.

Of the medium and low density polyethylene resins used therein, the low density polyethylene polymerized by the high pressure process is characterized by a low hardness and low cost. It is thus expected that a low cost cover stock providing a soft feel when hit is obtained by blending the low density polyethylene with the ionomer resin. It has been desired to develop a cover stock by blending with the ionomer resin a more proportion of the high-pressure-produced low density polyethylene.

However, the high-pressure-produced low density polyethylene is less dispersible in the ionomer resin because it contains many branches owing to the polymerization process. For this reason, the high-pressure-produced low density polyethylene is not recommended in JP-B 63-58856.

Allegedly, if more than 9 parts by weight of a medium to low density polyethylene is blended with 100 parts by weight of an ionomer resin, the blend experiences a substantial loss of resilience to below the practical level because of the poor dispersion of the medium to low density polyethylene. Also allegedly, if a high density polyethylene is blended with an ionomer resin, despite the reduced content of polyethylene, the resulting cover stock loses durability and becomes impractical.

SUMMARY OF THE INVENTION

An object of the invention is to provide a golf ball cover stock that has solved the above-mentioned problems of conventional golf ball cover stocks based on an ionomer resin in admixture with polyethylene, that is, a cover stock having improved durability, wear resistance, resilience and economy. Another object of the invention is to provide a golf ball using the cover stock.

The inventors are interested in a golf ball cover stock based on an ionomer resin in admixture with polyethylene. The inventors have found that by blending in this cover stock an epoxy group-modified polyolefin or low molecular weight polyethylene wax as a third component, the dispersion of polyethylene in the ionomer resin is significantly improved, allowing a larger amount of polyethylene to be blended. The resulting cover stock is highly durable and wear resistant. Additionally, the cover stock is improved in resilience and cost as compared with the conventional golf ball cover stock based on an ionomer resin in admixture with polyethylene.

The invention provides a golf ball cover stock primarily comprising a heated mixture of (a) an ionomer resin, (b) polyethylene, and (c) an epoxy group-modified polyolefin or (d) a low molecular weight polyethylene wax or both (c) and (d). A golf ball comprising a cover made of the cover stock is also provided.

DESCRIPTION OF THE PREFERRED EMBODIMENTS

The golf ball cover stock of the invention contains as a main component a heated mixture of (a) an ionomer resin, (b) polyethylene, and (c) an epoxy group-modified polyolefin and/or (d) a low molecular weight polyethylene wax.

The ionomer resin (a) is preferably selected from metal ion-neutralized copolymers of an olefin with an unsaturated carboxylic acid. The olefins used herein include those of 2 to 8 carbon atoms, with ethylene being preferred. The unsaturated carboxylic acids used herein include those of 3 to 6 carbon atoms, for example, acrylic acid, methacrylic acid, maleic acid and fumaric acid, with methacrylic acid and acrylic acid being preferred.

In the copolymers, the content of unsaturated carboxylic acid is generally 5 to 25% by weight, and preferably 10 to 20% by weight. Too less contents of unsaturated carboxylic acid would lead to low rigidity and poor resilience whereas too more contents would lead to brittle resins having a too high rigidity so that the durability of a ball against strikes lowers. That is, contents outside the range would raise problems on practical use.

In the copolymers, 20 to 80 mol % and more preferably 25 to 70 mol % of the carboxyl groups of the unsaturated carboxylic acid are preferably neutralized with metal ions. Copolymers with a degree of neutralization of less than 20 mol % would be short in rigidity and resilience whereas a degree of neutralization in excess of 80 mol % would detract from flow and workability and achieve no improvement in physical properties. Exemplary ions used for neutralization are $Li^+$, $Na^+$, $K^+$, $Zn^{++}$, $Ni^{++}$, $Cu^{++}$, $Pb^{++}$, and $Mg^{++}$. Of these, $Li^+$, $Na^+$, $Zn^{++}$ and $Mg^{++}$ are especially preferred. These metal ions are supplied as suitable compounds such as formates, acetates, nitrates, carbonates, hydrogen carbonates, oxides, hydroxides, and alkoxides.

The ionomer resins may be used alone. Also useful is a mixture of two or more ionomer resins neutralized with different metal cations.

If desired, the copolymer may contain an additional comonomer such as an acrylate because a softer terpolymer can be obtained.

The ionomer resin used herein is commercially available from Mitsui-Dupont Polychemical K.K. as Himilan 1557, Himilan 1601, Himilan 1605, and Himilan AM7318 which are sodium ion-neutralized ethylene-methacrylic acid copolymers; Himilan 1650 and Himilan 1706 which are zinc ion-neutralized ethylene-methacrylic acid copolymers; and Himilan 1855 and Himilan 1856 which are terpolymers with an unsaturated monomer such as acrylate.

Any polyethylene may be used as component (b). A low density polyethylene polymerized by the high pressure process is preferred. A high density polyethylene polymerized by the medium or low pressure process may also be advantageously used when the low molecular weight polyethylene wax (d) is used. The low density polyethylene usually has a specific gravity of 0.90 to 0.94. The high density polyethylene usually has a specific gravity of 0.95 to 0.97.

The high pressure process is by polymerizing purified ethylene under a pressure of about 600 to 1,000 atm., with a minor amount of air added, while heating at about 200° C. The medium pressure process is by polymerizing ethylene under a pressure of about 20 to 30 atm. in the presence of a chromium or similar catalyst while heating at about 150° C. The low pressure process is by polymerizing ethylene in the presence of titanium tetrachloride and triethylaluminum catalysts at a pressure of atmospheric pressure to about 5 atm. and a temperature of room temperature to about 70° C.

The high-pressure-produced polyethylene has branched side chains in places because ethylene monomers are forcedly joined under the impetus of high temperature and pressure during polymerization. These side chains prevent crystallization of polyethylene, which exhibits a low hardness.

By contrast, the medium or low-pressure-produced polyethylene is a less branched polyethylene because ethylene monomers are polymerized under low pressure in the presence of a catalyst. Because a less number of branches allows molecules to be closely concentrated and regularly aligned, the medium or low-pressure-produced polyethylene has a higher rigidity.

Since the low-density polyethylene and the high-density polyethylene are different in hardness and density as described above, a proper polyethylene may be selected and added to the ionomer resin depending on the desired hardness and density of the cover stock.

In the practice of the invention, the polyethylene should preferably have a Shore D hardness of up to 65, more preferably 40 to 64, most preferably 40 to 61. A polyethylene with a Shore D hardness of more than 65 would compromise the feel on shot and lose control due to a reduced spin rate.

As to the medium or high-density polyethylene, its Izod impact strength is desirably at least 50 J/m, more desirably at least 55 J/m, and most desirably at least 60 J/m. If the Izod impact strength is less than 50 J/m, blending the polyethylene with the ionomer resin would achieve no improvement in durability and in some cases, markedly compromise durability.

Examples of the low-density polyethylene used herein include Petrocen 219, Petrocen 339, Petrocen 340 and Petrocen 342 which are low-density polyethylene commercially available from Tosoh K.K. The high-density polyethylene is generally known as high impact polyethylene and commercially available as M6800 and M3800 from Keiyo Polyethylene K.K.

The ionomer resin (a) and the polyethylene (b) are preferably blended in a weight ratio of from 81:19 to 98:2, and more preferably from 85:15 to 95:5, provided that the sum of (a)+(b) is 100. A too small amount of polyethylene would be ineffective for the polyethylene to accomplish an improvement in durability whereas a too large amount of polyethylene would obstruct the dispersion of polyethylene in the ionomer resin, leading to poorer physical properties.

Component (c) is an epoxy group-modified polyolefin which may be a copolymer of an olefin monomer with an epoxy group-containing compound copolymerizable therewith. Ethylene is the preferred olefin monomer. Glycidyl acrylate or glycidyl methacrylate is useful as the epoxy group-containing compound.

In the epoxy group-modified polyolefin, another monomer may be used in addition to the olefin monomer and the epoxy group-containing compound for softening purposes. More specifically, a polymerizable monomer having an aliphatic unsaturated bond other than the olefin monomer, for example, acrylates, methacrylates and vinyl acetate is used as a comonomer in an effective amount to render the polymer more flexible. Exemplary acrylates and methacrylates used herein are esters of (meth)acrylic acid with aliphatic alcohols of 1 to 4 carbon atoms in which the hydrogen atom attached to a carbon atom may be replaced by a hydroxyl group, such as methyl (meth)acrylate, ethyl (meth)acrylate, and butyl (meth)acrylate.

Illustrative examples of the epoxy group-modified polyolefin include ethylene/glycidyl (meth)acrylate, ethylene/n-butyl acrylate/glycidyl (meth)acrylate, ethylene/methyl acrylate/glycidyl (meth)acrylate, ethylene/acrylate/glycidyl (meth)acrylate, and ethylene/glycidyl (meth)acrylate/vinyl acetate copolymers. Such epoxy group-modified polyolefins are commercially available, for example, under the trade name of "Elvaloy" from Mitsui-Dupont Polychemical K.K. and "Bond Fast" from Sumitomo Chemical K.K.

Preferably the epoxy group-modified polyolefin (c) is blended in an amount of 1 to 10 parts, and more preferably 1 to 5 parts by weight per 100 parts by weight of the ionomer resin (a) and the polyethylene (b) combined. More than 10 parts of the epoxy group-modified polyolefin would result in a mixture which has a low melt viscosity and is difficult to mold. Less than 1 part of the epoxy group-modified polyolefin would be ineffective for improving the dispersion of polyethylene in the ionomer resin.

Component (d) is a low molecular weight polyethylene wax. Specifically, the polyethylene wax has an average molecular weight of about 1,000 to 10,000, and preferably about 1,500 to 5,000. Such polyethylene wax is commercially available under the trade name of Sunwax 131-P, 151-P, 161-P, 165-P, and 171-P from Sanyo Chemical Industry K.K. The low molecular weight polyethylene wax functions not only as a dispersant for pigments, but also as a dispersant for polyethylene and thus assists in forming a micro-dispersion of polyethylene in the ionomer resin which is effective for improving durability. The polyethylene dispersed in the ionomer resin should preferably have a mean particle size of 0.5 to 1.5 $\mu$m. A mean particle size of less than 0.5 $\mu$m would be ineffective for improving durability whereas a mean particle size of more than 1.5 $\mu$m would compromise compatibility and lead to a substantial loss of durability.

For further improving the dispersion of polyethylene in the ionomer resin, a low molecular weight polyethylene wax modified with acid groups is advantageously used. Exemplary acid groups are carboxyl groups and acid anhydride groups. The low molecular weight polyethylene wax modified with acid groups should preferably have an acid value of 1 to 60 mg KOH/g, especially 10 to 60 mg KOH/g, as measured by the titration method. An acid value of less than 1 mg KOH/g would be ineffective for improving the dispersion of polyethylene whereas an acid value of more than 60 mg KOH/g might lead to a lowering of physical properties by the acid groups. The polyethylene wax modified with acid groups is commercially available under the trade name of Umex 2000 and Umex 1010 from Sanyo Chemical Industry K.K.

The amount of low molecular weight polyethylene wax (d) blended is preferably 0.1 to 6 parts, more preferably 0.5 to 4 parts, and most preferably 1.0 to 2.5 parts by weight per 100 parts by weight of the ionomer resin (a) and the polyethylene (b) combined. Less than 0.1 part would be ineffective for improving impact resistance whereas more than 6 parts would compromise resilience.

While the cover stock of the invention contains components (a), (b) and (c) and/or (d) as essential components, another resin component is used if desired. The other resin component may be selected from well-known resins, for example, thermoplastic polyester elastomers, thermoplastic polystyrene elastomers, thermoplastic polyolefin elastomers, and thermoplastic polyurethane elastomers. Such other resin components are preferably blended in an amount of less than 30%, and more preferably less than 20% by weight of the cover stock.

In the cover stock, various additives may be blended in addition to the above-described components. Exemplary additives include white pigments such as titanium dioxide, blue pigments, dispersants such as magnesium stearate, weight modifiers such as barium sulfate, fluorescent brighteners, ultraviolet absorbers, antioxidants, and photostabilizers. The amounts of these additives blended are not critical and conventional amounts may be blended.

The cover stock is prepared by admitting the above essential components into an internal mixer such as a mixing extruder, Banbury mixer or kneader, and heating therein at about 150 to 250° C. for about ½ to 15 minutes. The other resin component(s) may be heated and mixed together with the essential components or mixed into the heated mixture of the essential components.

Any desired method may be used for blending various additives other than the essential components. Exemplary methods are a simultaneous mixing method of blending additives together with the essential components and heat mixing them at the same time, and a successive mixing method of previously heat mixing the essential components and adding additives to the premix, followed by further heat mixing.

No particular limit is imposed on the specific gravity of the heated mixture. It is recommended that the heated mixture have a specific gravity of 0.9 to 1.5, preferably 0.9 to 1.3, and more preferably 0.95 to 1.0.

The invention also provides a golf ball having a cover made of the above-described cover stock. Illustratively, thread wound golf balls and two, three and multi-piece solid golf balls are included. It is only required that a core be enclosed in a cover. The material, diameter, weight, hardness and other factors of the solid or liquid center, solid core, and wound core may be determined as appropriate insofar as the objects of the invention are not impaired.

While the core is enclosed in a cover made of the cover stock according to the invention, the cover may be formed by any well-known method. For example, the cover stock is molded into a pair of hemispherical half-shells, the core is encased in the shells, and pressure molding is effected at 120 to 170° C. for 1 to 5 minutes. Alternatively, the molten cover stock is injected over the core disposed within a mold.

In the golf ball of the invention, the gage of the cover is not critical and is usually 1 to 4 mm, especially 1.3 to 2.3 mm. The cover may be a single layer or a multilayer structure of two or more layers. In the case of the multilayer structure, a layer of the inventive cover stock may be combined with a layer of a conventional cover stock.

The cover is provided on its surface with a multiplicity of dimples. The cover is subject to various surface treatments including leveling, stamping and paint coating.

For play, the golf ball of the invention must have a diameter of not less than 42.67 mm and a weight of not greater than 45.93 grams in accordance with the Rules of Golf.

There has been described a golf ball cover stock in which a component effective for improving the dispersion of polyethylene in an ionomer resin is blended so that a larger amount of polyethylene may be blended in a micro-dispersion form. The golf ball having a cover of this material offers a good feel when hit and is improved in durability and wear resistance.

EXAMPLE

Examples of the invention are given below by way of illustration and not by way of limitation. Parts are by weight (pbw).

Example I and Comparative Example I

A solid core having a diameter of 38.8 mm, a weight of 35.8 grams, and a hardness corresponding to a deflection of 3.3 mm under an applied load of 100 kg was prepared using a core composition based on cis-1,4-polybutadiene. The core was set in an injection mold.

A cover stock was prepared by heat mixing the components shown in Table 1 in a mixing twin-screw extruder at 200° C. for ½ minutes and chopping the extrudate into pellets. The cover stock was injected around the core in the mold, forming a two-piece solid golf ball having a cover of 1.8 mm thick.

The golf balls thus obtained were examined for hardness, initial velocity, and durability by the following tests, with the results shown in Table 2. The wear resistance of the cover stock was examined.

Ball Hardness

Ball hardness was expressed by a deflection (mm) of a ball under an applied load of 100 kg.

Initial Velocity

Using an apparatus of the type approved by USGA, an initial velocity was measured as prescribed by USGA.

Durability

Using a flywheel hitting machine, a ball was repetitively struck at a head speed of 38 m/s until the ball was broken. The number of strikes at rupture is reported.

Wear Resistance

A sheet of 1 mm thick was formed from each cover stock. Using a Taber abrader with an abrasive wheel H22, the sheet was tested at a rotational speed of 60 rpm and a number of revolutions of 1,000. An average abrasive wear is reported.

TABLE 1

| | | Cover stock | | | | | | | |
|---|---|---|---|---|---|---|---|---|---|
| | | E1 | E2 | E3 | CE1 | CE2 | CE3 | CE4 | CE5 |
| Components (pbw) | Himilan 1601 | | | | | 50 | | | |
| | Himilan 1557 | | | | | 50 | | | |
| | Himilan 1605 | 47.5 | 45 | 42.5 | 50 | | 47.5 | 45 | 42.5 |
| | Himilan 1706 | 47.5 | 45 | 42.5 | 50 | | 47.5 | 45 | 42.5 |
| | Petrocen 219 | 5 | 10 | 15 | | | 5 | 10 | 15 |
| | Bond Fast | 1 | 1 | 1 | | | | | |
| | Titanium dioxide | 4 | 4 | 4 | 4 | 4 | 4 | 4 | 4 |
| | Magnesium stearate | 1 | 1 | 1 | 1 | 1 | 1 | 1 | 1 |
| Specific gravity | | 0.99 | 0.99 | 0.99 | 0.99 | 0.99 | 0.99 | 0.99 | 0.99 |
| Cover hardness (Shore D) | | 62 | 62 | 61 | 63 | 61 | 62 | 62 | 61 |
| Abrasion wear (mg) | | 16 | 16 | 26 | 40 | 39 | 18 | 18 | 27 |

Himilan 1601: sodium ion neutralized ionomer resin, acid content 10% by weight, Shore D hardness 56, by Mitsui Dupont Polychemical K.K.

Himilan 1557: zinc ion neutralized ionomer resin, acid content 12% by weight, Shore D hardness 57, by Mitsui Dupont Polychemical K.K.

Himilan 1605: sodium ion neutralized ionomer resin, acid content 15% by weight, Shore D hardness 61, by Mitsui Dupont Polychemical K.K.

Himilan 1706: zinc ion neutralized ionomer resin, acid content 15% by weight, Shore D hardness 60, by Mitsui Dupont Polychemical K.K.

Petrocen 219: high-pressure-produced low density polyethylene, Shore D hardness 56, by Tosoh K.K.

Bond Fast GT621: ethylene-glycidyl methacrylate copolymer, by Sumitomo Chemical K.K.

Example II and Comparative Example II

A solid core having a diameter of 39.1 mm, a weight of 35.8 grams, and a hardness corresponding to a deflection of 3.3 mm under an applied load of 100 kg was prepared using a core composition based on cis-1,4-polybutadiene. The core was set in an injection mold.

A cover stock was prepared by heat mixing the components shown in Table 3 in a mixing twin-screw extruder at 200° C. for ½ minutes and chopping the extrudate into pellets. The cover stock was injected around the core in the mold, forming a two-piece solid golf ball having a cover of 1.8 mm thick.

The golf balls thus obtained were examined as in Example I, and the wear resistance of the cover stock was examined. The results are shown in Table 4.

TABLE 2

| | Ball | | | | | | | |
|---|---|---|---|---|---|---|---|---|
| | E1 | E2 | E3 | CE1 | CE2 | CE3 | CE4 | CE5 |
| Outer diameter (mm) | 42.7 | 42.7 | 42.7 | 42.7 | 42.7 | 42.7 | 42.7 | 42.7 |
| Weight (g) | 45.3 | 45.3 | 45.3 | 45.3 | 45.3 | 45.3 | 45.3 | 45.3 |
| Hardness (mm) | 2.58 | 2.58 | 2.58 | 2.57 | 2.59 | 2.58 | 2.58 | 2.59 |
| Initial velocity (m/s) | 77.5 | 77.4 | 77.2 | 77.6 | 77.2 | 77.3 | 77.2 | 77.0 |
| Durability (strikes) | 602 | 620 | 405 | 320 | 361 | 582 | 603 | 212 |

As seen from Table 2, the golf ball cover stocks containing a heated mixture of an ionomer resin, low-density polyethylene and epoxy-modified polyolefin as essential components (Examples 1 to 3) are improved in durability and wear resistance over the ionomer cover stocks (Comparative Examples 1 and 2). The golf ball cover stocks containing a heated mixture of an ionomer resin, low-density polyethylene and epoxy-modified polyolefin as essential components (Examples 1 to 3) are superior to the conventional cover stocks in the form of a blend of an ionomer resin and medium or low-density polyethylene (Comparative Examples 3 to 5) in that durability is satisfactory even when a large amount of low-density polyethylene is blended, and high resilience is exerted due to the improved dispersion of polyethylene.

Additionally, the mean particle size of dispersed polyethylene particles was measured as follows.

Mean Particle Size

A sample of the cover stock was machined to a breakable shape and cut with a notch of about 0.1 mm at a position to be broken. The sample was immersed in liquefied nitrogen for 30 minutes and then broken at the notch to expose a rupture cross-section, which was metallized and observed under SEM. In an image of X10,000, 100 polyethylene particles dispersed were randomly selected and measured for diameter, from which a mean particle size was calculated.

TABLE 3

| | | Cover stock | | | | | | | | | |
|---|---|---|---|---|---|---|---|---|---|---|---|
| | | E4 | E5 | E6 | E7 | E8 | E9 | CE6 | CE7 | CE8 | CE9 |
| Components (pbw) | Himilan 1601 | | | | | | | | 50 | | |
| | Himilan 1557 | | | | | | | | 50 | | |
| | Himilan 1605 | 47.5 | 45 | 42.5 | 45 | 45 | 45 | 50 | | 45 | 46 |
| | Himilan 1706 | 47.5 | 45 | 42.5 | 45 | 45 | 45 | 50 | | 45 | 46 |
| | High density polyethylene-1 | 5 | 10 | 15 | 10 | 10 | | | | 10 | |
| | High density polyethylene-2 | | | | | | | | | | 8 |
| | Low density polyethylene | | | | | | 10 | | | | |
| | Low molecular weight PE wax-1 | 1 | 1 | 1 | | | 1 | | | | |
| | Low molecular weight PE wax-2 | | | | 1 | | | | | | |
| | Low molecular weight PE wax-3 | | | | | 1 | | | | | |
| | Titanium dioxide | 4 | 4 | 4 | 4 | 4 | 4 | 4 | 4 | 4 | 4 |
| | Metal salt of stearic acid | 1 | 1 | 1 | 1 | 1 | 1 | 1 | 1 | 1 | 1 |
| Specific gravity | | 0.99 | 0.99 | 0.99 | 0.99 | 0.99 | 0.99 | 0.99 | 0.99 | 0.99 | 0.99 |
| Cover hardness (Shore D) | | 62 | 61 | 61 | 61 | 61 | 60 | 63 | 61 | 61 | 63 |
| Abrasion wear (mg) | | 21 | 26 | 32 | 27 | 25 | 16 | 40 | 39 | 28 | 29 |
| Mean particle size (μm) | | 0.8 | 0.9 | 1.3 | 0.9 | 0.8 | 0.9 | — | — | 1.8 | 1.6 |

Himilan 1601/1557/1605/1706 are shown above.

High density polyethylene-1: KEIYO Polyethylene M6800, Shore D hardness 59, Izod impact strength 60 J/m, by Keiyo Polyethylene K.K.

High density polyethylene-2: Hizex 2100J, Shore D hardness 63, Izod impact strength 39 J/m, by Mitsui Chemical K.K.

Low molecular weight polyethylene wax-1: Sunwax 131-P, average molecular weight 3500, by Sanyo Chemicals Industry K.K.

Low molecular weight polyethylene wax-2: Sunwax 161-P, average molecular weight 5000, by Sanyo Chemicals Industry K.K.

Low molecular weight polyethylene wax-3: Umex 1010, average molecular weight 4000, acid value 52 mg KOH/g, by Sanyo Chemicals Industry K.K.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball cover stock prepared by heating a mixture of (a) an ionomer resin, (b) polyethylene, and, as a third component which differs from (b), (d) a polyethylene wax.

2. The cover stock of claim 1 wherein the mixture contains 0.1 to 6 parts by weight of the polyethylene wax (d) per 100 parts by weight of the ionomer resin (a) and the polyethylene (b) combined.

3. The cover stock of claim 1 wherein the ionomer resin (a) and the polyethylene (b) are present in a weight ratio of from 81:19 to 98:2.

TABLE 4

| | Ball | | | | | | | | | |
|---|---|---|---|---|---|---|---|---|---|---|
| | E4 | E5 | E6 | E7 | E8 | E9 | CE6 | CE7 | CE8 | CE9 |
| Outer diameter (mm) | 42.7 | 42.7 | 42.7 | 42.7 | 42.7 | 42.7 | 42.7 | 42.7 | 42.7 | 42.7 |
| Weight (g) | 45.3 | 45.3 | 45.3 | 45.3 | 45.3 | 45.3 | 45.3 | 45.3 | 45.3 | 45.3 |
| Hardness (mm) | 2.58 | 2.59 | 2.59 | 2.59 | 2.59 | 2.60 | 2.57 | 2.59 | 2.59 | 2.57 |
| Initial velocity (m/s) | 77.5 | 77.3 | 77.2 | 77.3 | 77.3 | 77.4 | 77.6 | 77.2 | 77.3 | 77.4 |
| Durability (strikes) | 504 | 523 | 369 | 512 | 548 | 544 | 324 | 360 | 335 | 59 |

As seen from Table 4, the golf ball cover stocks containing a heated mixture of an ionomer resin, polyethylene having an Izod impact strength of more than 50 J/m and low molecular weight polyethylene wax as essential components (Examples 4 to 9) are improved in durability and wear resistance over the ionomer cover stocks (Comparative Examples 6 and 7).

Japanese Patent Application No. 10-230285 is incorporated herein by reference.

4. The cover stock of claim 1 wherein the polyethylene wax (d) has an number average molecular weight of 1,000 to 10,000.

5. The cover stock of claim 4 wherein the polyethylene (b) is a high-pressure-produced, low density polyethylene or a medium or low-pressure-produced, high density polyethylene.

6. The cover styock of claim 4 wherein the polyethylene (b) has a Shore D hardness of up to 65.

7. The cover stock of claim 4 wherein the polyethylene (b) has an Izod impact strength of at least 50 J/m.

8. The cover stock of claim 1 wherein the polyethylene wax (d) is modified with an acid anhydride or a carboxyl group and has an acid value of 1 to 60 mg KOH/g.

9. The cover stock of claim 1 wherein the ionomer resin (a) is a sodium, zinc, magnesium or lithium salt of a copolymer of an olefin having 2 to 8 carbon atoms with an unsaturated monocarboxylic acid having 3 to 8 carbon atoms.

10. The cover stock of claim 1 wherein the polyethylene (b) is a high-pressure-produced, low density polyethylene or a medium or low-pressure-produced, high density polyethylene.

11. The cover styock of claim 1 wherein the polyethylene (b) has a Shore D hardness of up to 65.

12. The cover stock of claim 1 wherein the polyethylene (b) has an Izod impact strength of at least 50 J/m.

13. A golf ball comprising a cover made of the cover stock of claim 1.

14. The golf ball cover stock prepared by heating a mixture of (a) an ionomer resin, (b) polyethylene, (c) an epoxy group-modified polyolefin and, as a fourth component which differs from (b), (d) a polyethylene wax.

* * * * *